US006491521B1

(12) United States Patent
Fowler, Jr.

(10) Patent No.: US 6,491,521 B1
(45) Date of Patent: Dec. 10, 2002

(54) FORMABLE MOUTHGUARD WITH TEETH

(75) Inventor: David M. Fowler, Jr., 1202 DeSoto Ave., Rome, GA (US) 30165

(73) Assignee: David M. Fowler, Jr., Rome, GA (US)

( * ) Notice: Subject to any disclaimer, the term of this patent is extended or adjusted under 35 U.S.C. 154(b) by 0 days.

(21) Appl. No.: 09/951,836

(22) Filed: Sep. 14, 2001

(51) Int. Cl.[7] ..... A61C 13/00; A61C 5/14
(52) U.S. Cl. ..... 433/167; 128/861
(58) Field of Search ..... 433/167, 171; 128/859, 861, 862

(56) References Cited

U.S. PATENT DOCUMENTS

| | | | | | |
|---|---|---|---|---|---|
| 3,987,546 | A | | 10/1976 | Trampe | |
| 4,580,980 | A | * | 4/1986 | Acquanetta | 433/167 |
| 5,031,638 | A | * | 7/1991 | Castaldi | 128/861 |
| 5,083,770 | A | | 1/1992 | Holland | |
| 5,277,203 | A | * | 1/1994 | Hays | 128/861 |
| 5,293,880 | A | | 3/1994 | Levitt | |
| 5,324,198 | A | | 6/1994 | Hazen | |
| 5,451,498 | A | * | 9/1995 | Hazen | 433/171 |
| 5,547,381 | A | * | 8/1996 | Nutting | 433/219 |
| 5,569,036 | A | * | 10/1996 | Goldiner et al. | 433/168.1 |
| D382,380 | S | * | 8/1997 | Prabel | D30/160 |
| D382,965 | S | | 8/1997 | Wagner | |
| 5,951,291 | A | | 9/1999 | Albert et al. | |
| 6,092,524 | A | * | 7/2000 | Barnes, Sr. | 128/859 |
| 6,295,988 | B1 | * | 10/2001 | Sue | 128/859 |
| 6,299,441 | B1 | * | 10/2001 | Novak | 433/29 |
| 6,321,752 | B1 | * | 11/2001 | Spottiswoode | 128/859 |

* cited by examiner

*Primary Examiner*—Ralph A. Lewis

(57) ABSTRACT

A formable mouthguard with teeth (10) having a mouthguard (12) which comprises a mouthguard outer side (12O) attached to a mouthguard inner side (12I) by a mouthguard bottom (12B) which has an open mouthguard bottom right end (12BR) and an open mouthguard bottom left end (12BL). An upper jaw (14) positioned on an outer surface of the mouthguard outer side (12O). The upperjaw (14) has an upper jaw gum (14A) interspersed with a plurality of upperjaw teeth (14B).

3 Claims, 3 Drawing Sheets

FORMABLE MOUTHGUARD WITH TEETH

BACKGROUND OF THE INVENTION

1. Field of the Invention

The present invention relates to a formable mouthguard. More particularly, the present invention relates to a formable mouthguard with teeth.

2. Description of the Prior Art

Mouthguards are used frequently in many sports. They primarily serve the purpose :of protecting a user's teeth upon impact.

Numerous innovations for a mouthguard have been provided in the prior art that are described as follows. Even though these innovations may be suitable for the specific individual purposes to which they address, they differ from the present invention as hereinafter contrasted.

In U.S. Pat. No. 3,987,546, invented by, Trampe, titled, Prosthetic denture and method of making same, a prosthetic denture is disclosed. The denture includes an assembly of hard acrylic teeth bonded to a "semi-hard" acrylic basemember. The base member is formulated from an acrylic polymer blend to yield preselected characteristics including hardness and thermal deformability so that fitting adjustments to conform to the wearer and to insure occlusive harmony can be accomplished with facility.

In U.S. Pat. No. 5,951,291, invented by, Albert, et al., titled, Cosmetic accessory device for teeth, a cosmetic accessory device for teeth that simulates the appearance of an assemblage of teeth and gum. The device includes agum portion and a tooth portion shaped and dimensioned to cover the user's upper or lower front teeth. The device is made oaf nontoxic, nonirritating, tasteless, odorless, resilient, easily cleaned and chemically stable material that does not stick to natural teeth, gums, or most dental work. In use, the device is held in place by custom-fitted inner projections that match the spaces between the user's own front teeth and (optionally) a shelf extending just across the front teeth. Unlike typical conventional novelty dental devices, the natural teeth and gums are not completely covered, so the device is comfortable to wear and does not interfere with natural speech or bite closure.

In U.S. Pat. No. D382,965, invented by, Wagner, titled, Mouthguard, an ornamental design for a mouthguard, as shown and described.

In U.S. Pat. No. 5,324,198, invented by, Hazen, titled, Denture covering existing teeth and gums, a device which includes two separate impression-molded all gum and cap-cup encasements (upper and lower arches) withveneered artificial teeth mounted to the encasement walls. The veneered encasements comprise the completed all gum and cap-cup dental device. The completed cap-cup encasements cover the upper and lower arches of full sets of natural teeth and gums.

In U.S. Pat. No. 5,293,880, invented by, Levitt, titled, Athletic mouthguard, an athletic mouthguard adapted for use by athletes and other persons engaged in physical activities which might result inocclusal or craniofacial stress. In one embodiment, the athletic mouthguard is a unitary structure which comprises a mouthpiece and an elongated strap adapted for attachment to the face mask of a helmet or the like. The mouthpiece, which is designed for use over the upper set of teeth of. the wearer, includes an inner peripheral wall, an outer peripheral wall, and a connecting wall,the inner surfaces of which define a channel.

The occlusal surface of the channel is more narrow in the anterior region and becomes more broad as one moves posteriorly so as to accommodate the non-uniform widths of the various teeth. In addition,the occlusal surface of the channel becomes progressively more concavely-shaped as one moves posteriorly from the firstbicuspid tooth to accommodate the increasing convexity of the posterior teeth. The buccal surface of the channel is shaped to a pair of retention bars, which serve to retain the mouthpiece against the upper set of teeth. The inner peripheral wall and theouter peripheral wall of the mouthpiece curve and taper in the vestibule and palatal areas to conform to the shape of the upperjaw. The connecting wall is thicker in the posterior regions than in the anterior regions so that an upwardly directed blow is delivered more to the posterior teeth than to the anterior teeth.

In: U.S. Pat. No. 5,083,770, invented by, Holland, titled, Theatrical accessory, a blood dripping fang theatrical accessory is disclosed. Controlled dripping of simulated blood from discharge ports of a bladder of the accessory may be effected by the user. The accessory has a hollow backed thin, flexible rubber-like shellsimulating the appearance of an assemblage of fangs, teeth and gum. A bladder having a main body and a pair of tubular bodybranches is mounted on the back of the shell with its tubular body branches nested in the hollow backs of the fangs, the tubularbody branches having apertures adjacent the tips of the fangs remote from the main body. Resilient material couples the bladder-branches to the fangs. The accessory may be held in the mouth of the user with the fang portions projecting therefrom. The bladder portion is engageable by part of the tongue of the user which may compress the bladder to discharge simulated blood from the apertures adjacent the fang tips and interrupt or terminate such discharge by stopping further compression or by decompression of the bladder.

The aforementioned patents differ from the present invention because the patented inventions fail to describe and/or claim one or more of the following features: thermoformable athletic mouthguard having an inner and outer side and bottom, mouthguard having a natural gum color to simulate the appearance of the user's real gums, and 3-Dimensional teeth manufactured from thermoformable material positioned within the outer side.

Numerous innovations for a mouthguard have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a formable mouthguard. More particularly, the present invention relates to a formable mouthguard with teeth.

The types of problems encountered in the prior art are the mouthguards are plain looking and not intimidating to opponents.

In the prior art, unsuccessful attempts to solve this problem were attempted namely: colored mouthguards. However, the problem was solved by the present invention because it incorporated 3-Dimensional teeth and gum.

Innovations within the prior art are rapidly being exploited in the field of sports.

The present invention went contrary to the teaching of the art which describes and claims clear or colored thermoformable mouthguards.

The present invention solved a long felt need for a mouthguard capable of intimidating opponents.

A synergistic effect was produced utilizing the present invention due to the following facts and results from experimentation: the intimidation factor increased winnings of teams utilizing the invention.

Accordingly, it is an object of the present invention to provide a formable mouthguard with teeth having a mouthguard and upper jaw.

More particularly, it is an object of the present invention to provide the mouthguard having a mouthguard outer side, mouthguard inner side, mouthguard bottom, mouthguard bottom right end, and mouthguard bottom left end.

In keeping with these objects, and with others which will become apparent hereinafter, one feature of the present invention resides, briefly stated, in the upper jaw having a upper jaw gum and upper jaw teeth.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—formable mouthguard with teeth (10)
12—mouthguard (12)
12O—mouthguard outer side (12O)
12I—mouthguard inner side (12I)
12B—mouthguard bottom (12B)
12BR—mouthguard bottom right end (12BR)
12BL—mouthguard bottom left end (12BL)
14—upperjaw(14)
14A—upper jaw gum (14A)
14B—upper jaw teeth (14B)

DESCRIPTION OF THE PREFERRED EMBODIMENT

Figure 1:
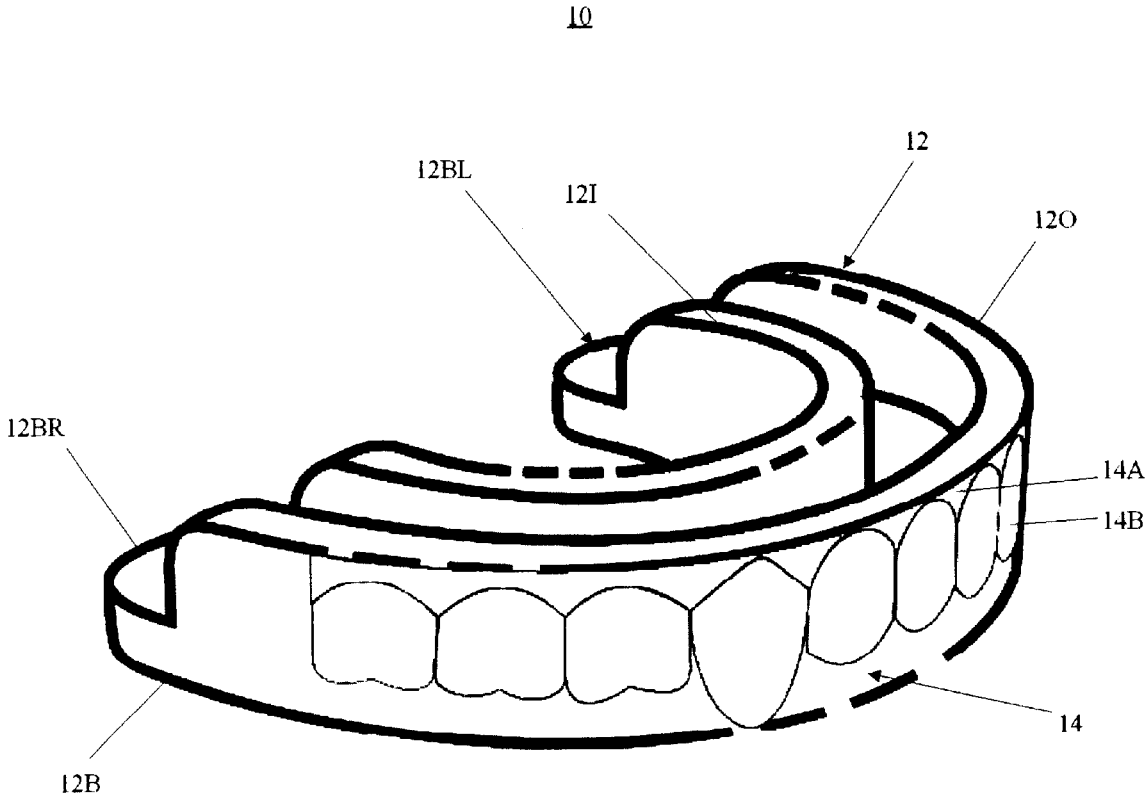
FIG. 1 is a top right perspective view of a formable mouthguard with teeth (10).
Figure 2:
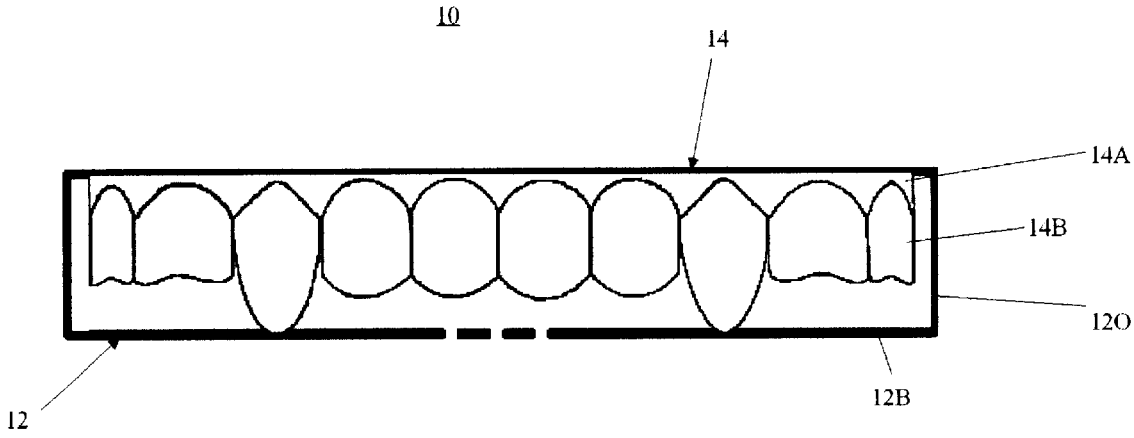
FIG. 2 is a front view of a formable mouthguard with teeth (10).
Figure 3:
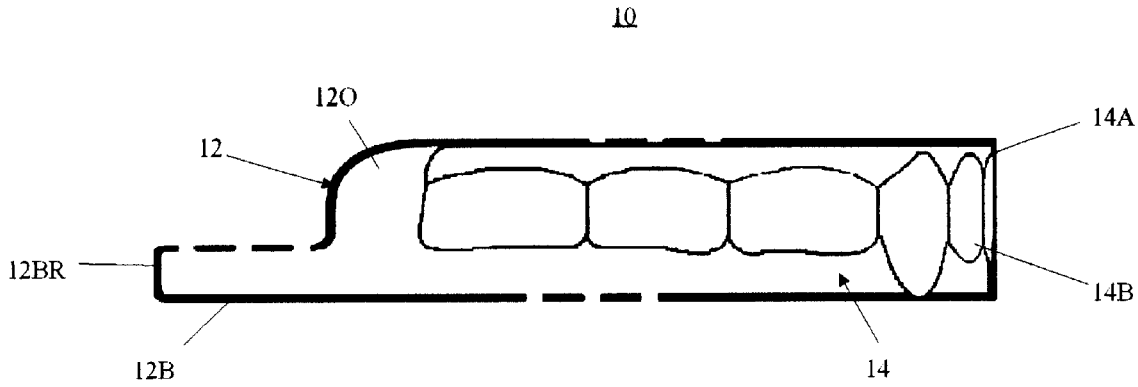
FIG. 3 is a right side view of a formable mouthguard with teeth (10).

Referring to FIGS. 1, 2 and 3 which are a top right perspective view, front view, and right side view of a formable mouthguard with teeth (10): comprising a mouthguard (12) which comprises a mouthguard outer side (12O) attached to a mouthgutard inner side (12I) by a mouthguard bottom (12B) which comprises an open mouthguard bottom right end (12BR) and an open mouthguard bottom left end (12BL). The mouthguard (12) is manufactured from a formable material which when heated above normal human body temperature of 98.6°, the mouthguard (12) is pliable and hardens at or below normal human body temperature. The mouthguard (12) is manufactured from a material selected from a group consisting of plastic, plastic composite, rubber and rubber composite.

The formable mouthguard with teeth (10) further comprises an upperjaw (14) positioned on an outer surface of the mouthguard outer side (12O). The upper jaw (14) comprises an upper jaw gum (14A) interspersed with a plurality of upper jaw teeth 14B). The upper jaw (14) is manufactured from a material selected from a group consisting of porcelain, ceramic, ivory, wood, wood composite, glass, plastic, plastic composite, rubber and rubber composite.

It will be understood that each of the elements described above, or two or more together, may also find a useful application in other types of constructions differing from the type described above.

While the invention has been illustrated and described as embodied in a mouthguard, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A formable mouthguard with teeth (10) comprising:

A) a mouthguard (12) which comprises a mouthguard outer side (12O) attached to a mouthguard inner side (12I) by a mouthguard bottom (12B), wherein when said mouthguard is positioned on a user's upper teeth the mouthguard bottom acts as a cushion contacting the user's upper and lower teeth when the upper and lower teeth are moved toward one another, said mouthguard (12) is manufactured from a formable material which when heated above normal human body temperature of 98.60° is pliable and hardens at or below normal human body temperature; and B) an upper jaw (14) securely attached to an outer surface of the mouthguard outer side (12O), the upper jaw (14) comprises a cross sectional cut of an upper jaw gum (14A) interspersed with a plurality of cross sectional cuts of upper jaw teeth (14B).

2. The formable mouthguard with teeth (10) as described in claim 1, wherein the mouthguard (12) is manufactured from a material selected from a group consisting of plastic, plastic composite, rubber and rubber composite.

3. The formable mouthguard with teeth (10) as described in claim 1, wherein the upper jaw (14) is manufactured from a material selected from a group consisting of porcelain, ceramic, ivory, wood, wood composite, glass, plastic, plastic composite, rubber and rubber composite.

* * * * *